US008272549B1

(12) United States Patent
Corkren

(10) Patent No.: US 8,272,549 B1
(45) Date of Patent: Sep. 25, 2012

(54) OFFSET, DOUBLE-SIDED TAPE DISPENSER

(76) Inventor: Steven M. Corkren, Halifax, MA (US)

( * ) Notice: Subject to any disclaimer, the term of this patent is extended or adjusted under 35 U.S.C. 154(b) by 358 days.

(21) Appl. No.: 12/586,940

(22) Filed: Sep. 30, 2009

(51) Int. Cl.
*B65H 35/07* (2006.01)

(52) U.S. Cl. ..... 225/34; 225/39; 225/56

(58) Field of Classification Search ..... 225/56, 225/39, 47, 79, 81, 34, 53, 51; 428/27; 156/527; 242/588.3, 588.6, 590, 594, 594.2
See application file for complete search history.

(56) References Cited

U.S. PATENT DOCUMENTS

| | | | | |
|---|---|---|---|---|
| 65,436 | A | 6/1867 | Rile | |
| 1,726,744 | A | 9/1929 | Krug | |
| RE19,128 | E | 4/1934 | Drew | |
| 2,030,135 | A | 2/1936 | Carpenter | |
| 2,210,233 | A | 8/1940 | De Lillo | |
| 2,328,057 | A | 8/1943 | Coulter | |
| 2,352,445 | A * | 6/1944 | Pinckney | 225/20 |
| 2,424,486 | A * | 7/1947 | Miller | 225/25 |
| 2,565,509 | A | 8/1951 | Marcin | |
| 2,708,076 | A * | 5/1955 | Polster et al. | 225/34 |
| 2,759,545 | A * | 8/1956 | Rizza | 225/34 |
| 2,808,358 | A | 10/1957 | Masse | |
| 3,021,250 | A | 2/1962 | La Voie | |
| 3,042,104 | A | 7/1962 | Bevier | |
| 3,950,214 | A | 4/1976 | Pool et al. | |
| 4,033,803 | A | 7/1977 | Coder | |
| 4,263,347 | A | 4/1981 | Banta | |
| RE30,787 | E | 11/1981 | Pool et al. | |
| 4,341,828 | A | 7/1982 | Stephens | |
| 4,415,400 | A * | 11/1983 | Rammelmeyr | 156/555 |
| 4,582,737 | A | 4/1986 | Torgerson et al. | |
| 4,714,210 | A * | 12/1987 | Howell | 242/422.4 |
| 4,770,914 | A | 9/1988 | Torgerson et al. | |
| 4,839,206 | A | 6/1989 | Waldenberger | |
| 4,844,973 | A | 7/1989 | Konishi et al. | |
| 4,917,753 | A | 4/1990 | Torgerson et al. | |
| 4,981,537 | A | 1/1991 | Heil et al. | |
| 5,049,445 | A | 9/1991 | Arvidsson et al. | |
| 5,098,786 | A | 3/1992 | Hanke | |
| 5,130,185 | A | 7/1992 | Ness | |
| 5,340,629 | A | 8/1994 | Rodighiero | |
| 5,658,632 | A | 8/1997 | Krabill | |
| 5,660,922 | A | 8/1997 | Herridge et al. | |
| 5,750,254 | A | 5/1998 | Starkey | |
| 5,954,257 | A * | 9/1999 | Panneri et al. | 225/39 |
| 7,028,736 | B1 | 4/2006 | Miller | |
| 7,077,185 | B2 | 7/2006 | Steinberger | |
| 2001/0023882 | A1 * | 9/2001 | Gilkes | 225/26 |
| 2007/0246153 | A1 * | 10/2007 | Schurman | 156/185 |

* cited by examiner

*Primary Examiner* — Laura M. Lee
(74) *Attorney, Agent, or Firm* — John P. McGonagle

(57) ABSTRACT

An offset, double-sided tape dispenser. The dispenser mounts two independent rolls of single surface adhesive tape on a common spindle. One of the rolls is inverted resulting in one roll wound clockwise and the other roll wound counter clockwise. The tapes are simultaneously drawn from the two rolls through a guide, across a roller and then a cutter. The clockwise wound roll tape has its adhesive surface facing upward as the tape crosses the roller. The counter clockwise wound roll tape has its adhesive surface facing downward as the tape crosses the roller. The clockwise wound roll tape is positioned beneath the counter clockwise wound tape as the tape passes through the guide. This results in the counter clockwise tape being joined to the clockwise tape as both tapes pass over the roller. The resulting double sided adhesive tape is then formed into desired lengths by the cutter. The degree of single tape overlap, resulting offset and resulting width of the resulting double sided adhesive tape is determined by the width of the guide.

1 Claim, 4 Drawing Sheets

PRIOR ART

OFFSET, DOUBLE-SIDED TAPE DISPENSER

BACKGROUND OF THE INVENTION

This invention relates to tape dispensers and, in particular, to a dispenser for joining two single adhesive tapes to form and dispense an offset, double-sided adhesive tape.

Single surface adhesive tape, such as masking tape, is well known. For some painting operations, such as spray painting, it is frequently necessary to protect or mask an area that is wider than the width of conventional masking tape. When such a requirement exists, it is common to position a sheet of paper, card board, foil, plastic, or the like over the area to be protected, and to position strips of masking tape about the edges of the sheet, such that the masking tape borders the areas to be painted and secures the sheet. Proper positioning of the sheet and masking tape strips can be a comparatively time-consuming process, particularly if the area to be protected is large.

Double sides adhesive tape has been proposed to facilitate such operations. Double sided adhesive tape is tape that includes adhesive on both sides. The double sided adhesive tape is stuck with one of its adhesive sides in the customary manner to a surface to be covered, while the still free adhesive surface on the other side of the double adhesive tape may be used for holding coverup material, such as, for example, foil, paper, cardboard, etc. This material can be adhered by an easy pressure on the free adhesive side. Historically, double sides adhesive tape has not achieved widespread use, principally because double sided adhesive tape cannot be formed into a roll without the use of a release liner between adjacent tape layers.

The prior art has attempted to overcome this problem, by using a dispenser which forms a double sided adhesive tape from two single surface adhesive tapes as the double sided adhesive tape is dispensed. U.S. Pat. No. 4,415,400 discloses such a dispenser which is comprised of two separate spindles each holding a supply of rolled up single adhesive tape. The spindles are mounted within a frame. Means for joining the single surfaced adhesive tapes are provided prior to the joined tapes being dispensed. U.S. Pat. No. 4,582,737 discloses an apparatus for making a double surfaced adhesive tape comprised of two separate rollers, each roller having a roll of single surfaced tape. A third roller is provided for combining the single surfaced tapes into a roll of double sided tape. U.S. Pat. No. 7,028,736 discloses a frame structure with two spindles for supporting first and second rolls of tape. First and second guide members are also attached to the frame for guiding the tape strips to overlap one another with respective adhesive sides opposite one another.

SUMMARY OF THE INVENTION

The present invention provides an offset, double-sided tape dispenser. The present invention dispenser mounts two independent rolls of single surface adhesive tape on a common spindle. One of the rolls is inverted resulting in one roll wound clockwise and the other roll wound counter clockwise. The tapes are simultaneously drawn from the two rolls through a guide, across a roller and then a cutter. The clockwise wound roll tape has its adhesive surface facing upward as the tape crosses the roller. The counter clockwise wound roll tape has its adhesive surface facing downward as the tape crosses the roller. The clockwise wound roll tape is positioned beneath the counter clockwise wound tape as the tape passes through the guide. This results in the counter clockwise tape being joined to the clockwise tape as both tapes pass over the roller.

The resulting double sided adhesive tape is then formed into desired lengths by the cutter. The degree of single tape overlap, resulting offset and resulting width of the resulting double sided adhesive tape is determined by the width of the guide.

The present invention is simpler, less expensive and easier to use than prior art double surfaced adhesive dispensers. Prior art devices have preset overlaps and resulting double sided adhesive tape widths. The present invention has an adjustable guide which provides overlap variability.

These, together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
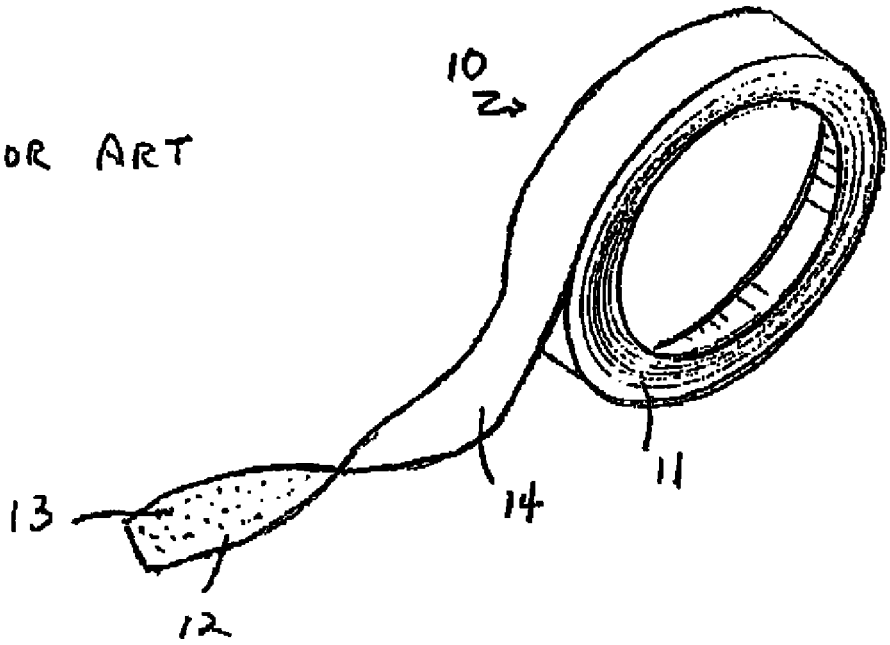
FIG. 1 PRIOR ART
FIG. 1 is a perspective view of a roll of single sided tape.

Referring to the drawings in detail wherein like elements are indicated by like numerals, there is shown a dispenser 20 constructed according to the principles of the invention.

Figure 2:
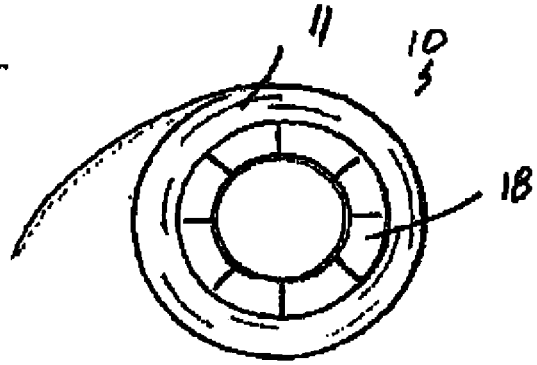
FIG. 2 is a side view with the roll of single sided tape mounted on a spool.
Figure 3:
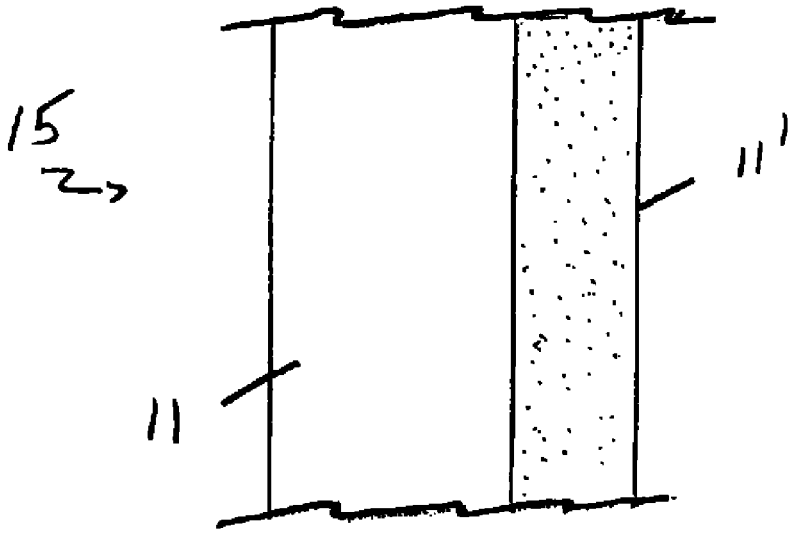
FIG. 3 is a top view of a section of double sided tape.
Figure 4:
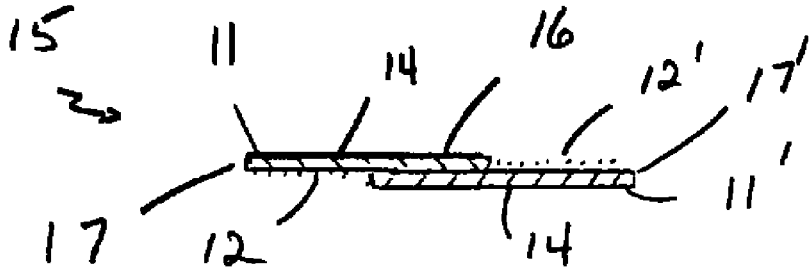
FIG. 4 is a cross-sectional view thereof.

Referring more particularly to FIGS. 1-2, there is shown a typical roll 10 of single sided tape 11, said tape 11 having two surfaces, one surface 12 with an adhesive 13, the other opposite surface 14 being adhesive free. FIGS. 3 and 4 illustrates an offset, double sided tape 15 formed from the two single sided tapes 11, 11'. The double sided tape center portion 16 is that portion of the tape adhesive surfaces 12, 12 'which overlap. The width of the double sided tape 15 is defined as the distance from the outside 17 of one tape 11 to the outside 17' of the other tape 11'.

Figure 5:
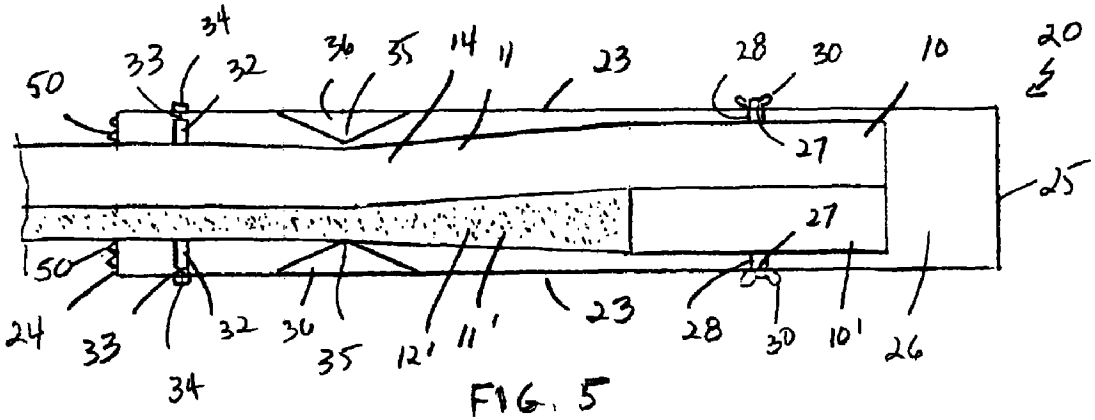
FIG. 5 is a top view of the double sided dispenser.
Figure 6:
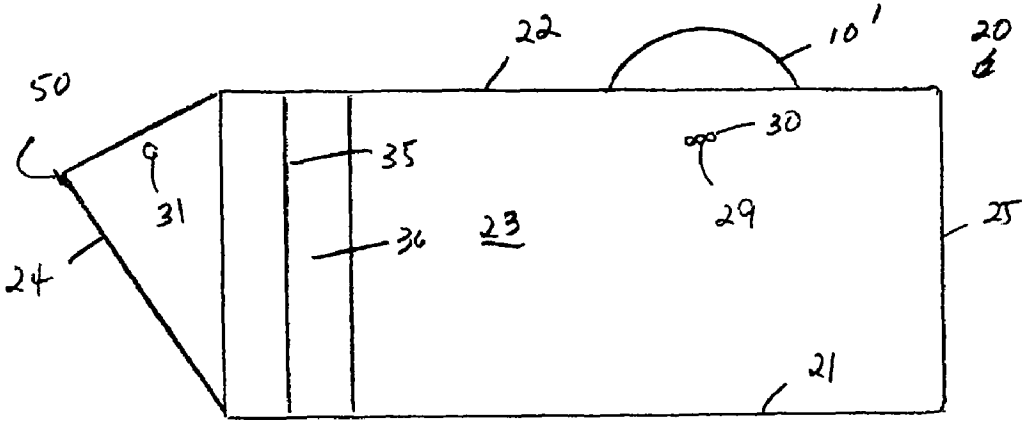
FIG. 6 is a side view thereof.

Referring more particularly to FIGS. 5-6, there is shown an offset, double sided, tape dispenser 20. The dispenser 20 has a bottom base 21, an open top 22, two opposite sides 23, a front 24 and a rear 25, said bottom, top, sides, front and rear defining a dispenser hollow interior 26. Said dispenser front 24 and rear 25 define a dispenser longitudinal axis. A rear aperture 27 is formed in each dispenser side 23, near to the dispenser rear 25 and dispenser top 22. A single tape spindle 28 is mounted laterally within the dispenser interior 26 and extending through each rear aperture 27. The tape spindle 28 has two ends 29 protruding through the dispenser side rear apertures 27. An adjustable fastener 30 is attached to each spindle end 29. The adjustable fastener 30 sets a desired amount of rotational drag for the tape spindle 28.

The dispenser 20 is further comprised of a forward aperture 31 formed in each dispenser side 23, near to the dispenser front 24 and dispenser top 22. A roller 32 having two ends 33 is mounted laterally within the dispenser interior 26 with the roller ends 33 extending through the forward apertures 31. A forward fastener 34 is attached to each roller end 33.

The dispenser 20 is further comprised of two vertical guides 35 within the dispenser interior 26, each guide being positioned adjacent a dispenser side 23 directly opposite the other guide. The guides 35 are longitudinally positioned between the roller 32 and the tape spindle 28. The guides may be fixed or adjustable. The purpose of the guides 35 is to force the tape 11 being drawn from the tape spools 18, 18' to overlap. The distance between the guides 35 determines the overall width of the offset, double sided tape 15. In a first embodiment shown in FIGS. 5 and 6, fixed guides 35 are used and are comprised of an inward bend 36 in the dispenser sides 23, the bend being made along a vertical axis.

Figure 7:
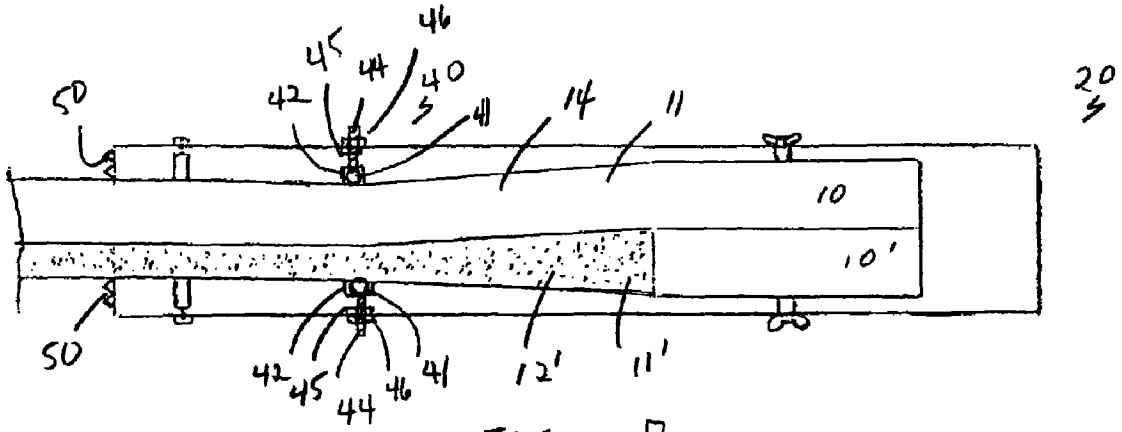
FIG. 7 is a top view of an alternate embodiment dispenser.
Figure 8:
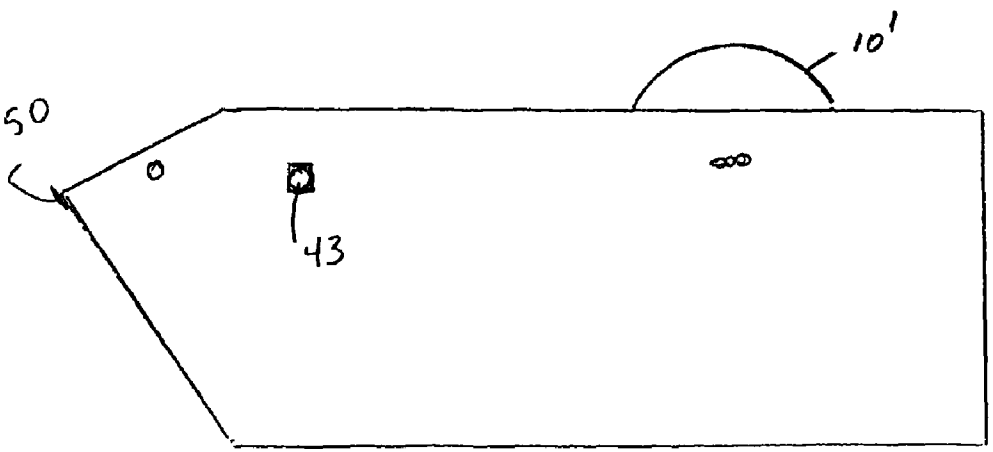
FIG. 8 is a side view thereof.

Referring more particularly to FIGS. 7 and 8, an adjustable guide mechanism 40 is shown. The adjustable guide mechanism 40 is comprised of two elongated, vertical posts 41, each post 41 terminating at a lower end in a shoe 42 slidably resting on the dispenser bottom 21 within the dispenser interior 26. The adjustable guide mechanism 40 is further comprised of two guide apertures 43 formed in each dispenser side 23, longitudinally positioned between the forward apertures 31 and the rear apertures 27. An elongated threaded element 44 is fixedly attached to each post 41, said threaded element having a first threaded nut 45 threadingly attached thereto. Each threaded element 44 is extended through a guide aperture 43 and engaged by a second threaded nut 46. Manipulation of the threaded nuts 45, 46 permits the operator to adjust the distance between both guide posts 41 and thereby the offset between tapes 11, 11', and the resulting width of the double sided tape 15.

Referring more particularly to FIGS. 5-8, the dispenser 20 is further comprised of a lateral cutter 50 attached to the dispenser front 24 at the dispenser top 22.

In operation, each tape roll 10 is mounted on a spool 18. Two tape roll spools 18 are mounted on the spindle 28. To provide tape roll counter rotation, one spool 18' is inverted, resulting in one tape roll 10' wound clockwise and the other tape roll 10 wound counter clockwise. As tape 11, 11' is simultaneously drawn from each roll 10, 10' toward the dispenser front 24, the clockwise wound roll tape 11' has its adhesive surface 12' facing upward and the counter clockwise wound roll tape 11 has its adhesive surface 12 facing downward. The guides, 35 or 40, bring the tapes together thereby determining the offset between tapes 11, 11', and the resulting width of the double sided tape 15. The tapes 11, 11' are joined on the roller 32 as the tapes are pulled toward the dispenser front 24 thereby forming a offset, double sided tape 15. The double sided tape 15 is then drawn over the cutter 50 a desired distance and then pulled down cutting the double sided tape 15. The lateral axis of the roller 32 is vertically higher than the lateral axis of the cutter 50.

It is understood that the above-described embodiment is merely illustrative of the application. Other embodiments may be readily devised by those skilled in the art which will embody the principles of the invention and fall within the spirit and scope thereof.

I claim:

1. An offset, double-sided tape dispenser for dispensing an offset, double sided tape formed from two single sided tapes, comprising:

a dispenser having a bottom base, an open top, two opposite sides, a front and a rear, said bottom, top, sides, front and rear defining a dispenser hollow interior, said dispenser front and rear defining a dispenser longitudinal axis;

a rear aperture formed in each dispenser side, near to the dispenser rear and dispenser top;

a single tape spindle mounted laterally the dispenser interior and extending through each said rear aperture, said tape spindle having two ends protruding through the dispenser side rear apertures;

a forward aperture formed in each dispenser side, near to the dispenser front and dispenser top;

a roller having two ends mounted laterally within the dispenser interior with a forward fastener attached to each roller end;

two vertical guides within the dispenser interior, each guide being positioned adjacent a dispenser side directly opposite the other guide; said guides longitudinally positioned between the roller and the tape spindle;

a lateral cutter attached to the dispenser front at the dispenser top;

two rolls of single sided each mounted on a spool, each said roll having two surfaces, one surface with an adhesive and the other opposite surface being adhesive free, said tape roll spools being mounted on said spindle, one spool being inverted, resulting in one tape roll wound clockwise and the other tape roll wound counter clockwise;

wherein said tape is adapted to being simultaneously drawn from each roll toward the dispenser front, across said roller and said cutter, said clockwise wound roll tape having its adhesive surface facing upward and the counter clockwise wound roll tape having its adhesive surface facing downward, said to tapes being joined on the roller as the tapes pulled toward the dispenser front thereby forming a offset, double sided tape;

wherein said guides are adapted to forcing said drawn tape to overlap thereby determining the offset between tapes and a resulting width of the offset double sided tape;

wherein the roller has a lateral axis positioned vertically higher than a cutter lateral axis;

wherein said vertical guides are adjustable, and are comprised of an adjustable guide mechanism comprising:

two elongated, vertical posts, each post terminating at a lower end in a shoe slidably resting on the dispenser bottom within the dispenser interior;

two guide apertures formed in each dispenser side, longitudinally positioned between the forward apertures and the rear apertures;

an elongated threaded element fixedly attached to each said vertical post, each said threaded element having a first threaded nut threadingly attached thereto, each threaded element being extended through a guide aperture and engaged by a second threaded nut;

wherein manipulation of the threaded nuts permits the operator to adjust the distance between both guide posts and thereby the offset between tapes, and the resulting width of the double sided tape.

* * * * *